US005341730A

United States Patent [19]

Tydiks

[11] Patent Number: 5,341,730

[45] Date of Patent: Aug. 30, 1994

[54] SCREW PRESS HAVING A PLURALITY OF THROTTLE POINTS AND AT LEAST ONE CAM MOVABLE TRANSVERSELY THERETO

[75] Inventor: B. Tydiks, Hamburg, Fed. Rep. of Germany

[73] Assignee: Maschinenfabrik Reinartz GmbH & Co. KG, Neuss, Fed. Rep. of Germany

[21] Appl. No.: 66,662

[22] Filed: May 25, 1993

[30] Foreign Application Priority Data

May 26, 1992 [DE] Fed. Rep. of Germany ... 9207096[U]

[51] Int. Cl.[5] ..... B30B 9/14

[52] U.S. Cl. ..... 100/37; 100/98 R; 100/117; 100/127; 100/145

[58] Field of Search ..... 100/37, 39, 98 R, 117, 100/125–127, 145, 150

[56] References Cited

U.S. PATENT DOCUMENTS

| | | | |
|---|---|---|---|
| 1,297,901 | 3/1919 | Peerson | 100/98 R |
| 2,466,492 | 4/1949 | Sizer | 100/37 |
| 3,111,080 | 11/1963 | French et al. | 100/37 |
| 3,645,200 | 2/1972 | Craddock et al. | 100/98 R |
| 4,289,067 | 9/1981 | Hanak | 100/98 R X |

FOREIGN PATENT DOCUMENTS

| | | | |
|---|---|---|---|
| 0017809 | 10/1980 | European Pat. Off. . | |
| 548411 | 4/1932 | Fed. Rep. of Germany | 100/98 R |
| 2633524 | 2/1977 | Fed. Rep. of Germany . | |
| 2751703 | 5/1979 | Fed. Rep. of Germany . | |
| 2922286 | 12/1979 | Fed. Rep. of Germany . | |
| 2915538 | 12/1982 | Fed. Rep. of Germany . | |
| 3150766 | 6/1983 | Fed. Rep. of Germany . | |
| 2263884 | 10/1975 | France . | |
| 2427194 | 12/1979 | France . | |
| 737240 | 5/1980 | U.S.S.R. | 100/117 |
| 1021634 | 6/1983 | U.S.S.R. | 100/117 |
| 1381003 | 3/1988 | U.S.S.R. | 100/117 |

*Primary Examiner*—Stephen F. Gerrity
*Attorney, Agent, or Firm*—Joseph W. Berenato, III

[57] ABSTRACT

A screw press for pressing off fluids, especially from oil seeds, has a screw (1) and, surrounding this screw (1), a fluid-permeable mantle (2), particularly a screen, whereby the screw shaft (3) and the mantle (2) form between them a screw channel (6) with a cross-section that decreases towards the transport direction of the screw (1), and whereby in the screw channel (6) at least one throttle point (7,8,9) is provided for building up zones of high pressure, and a cross-section expansion is provided in transport direction following the throttle point (7,8,9) for relaxing the high pressure at least partially. In order to achieve a higher efficiency, at least one cam (10) that may be moved transversely to the transport direction of the screw (1) is provided in the area of at least one of the existing throttle points (8,9) in the screw channel (6).

15 Claims, 1 Drawing Sheet

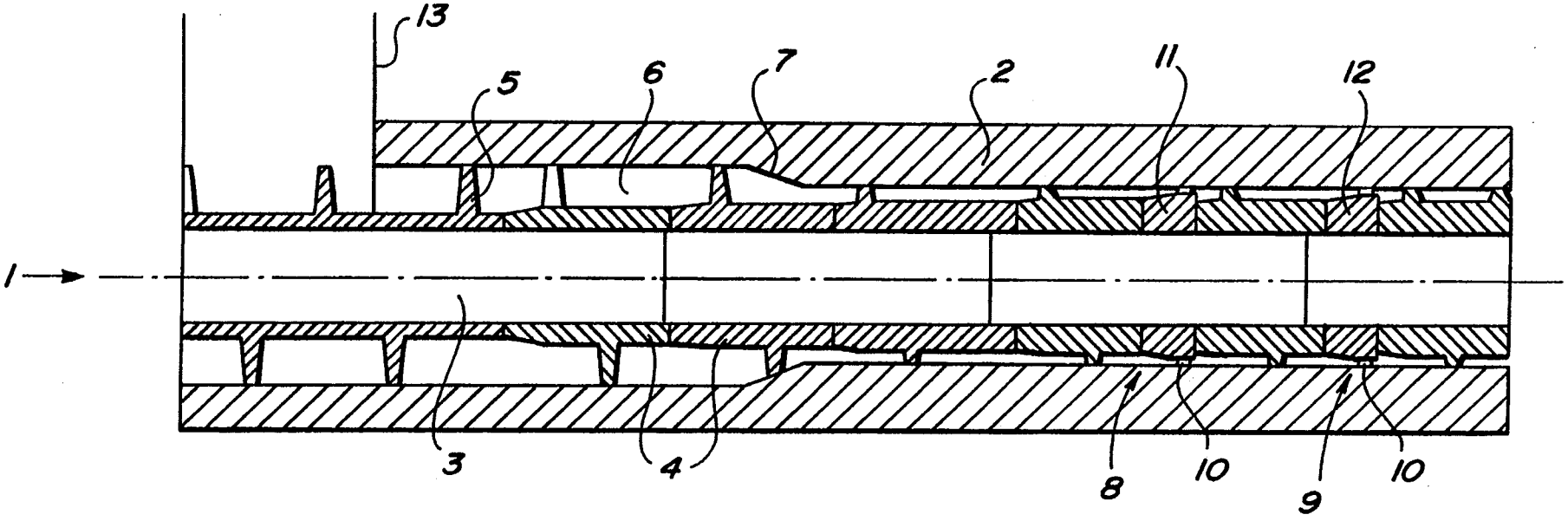
12
11
2
7
6
5
13
10
9
10
8
4
3
1

SCREW PRESS HAVING A PLURALITY OF THROTTLE POINTS AND AT LEAST ONE CAM MOVABLE TRANSVERSELY THERETO

The invention relates to a screw press for pressing off fluids, especially from oil seeds, with a screw. Surrounding this screw is a fluid-permeable mantle, such as a screen, forming between them a screw channel with a cross-section that decreases in the transport direction of the screw. In the screw channel at least one throttle point is provided for building up zones of high pressure, and a larger cross-sectional area is provided in the transport direction following the throttle point for reducing the high pressure at least partially. The invention also relates to a process for pressing off fluids, especially from oil seeds, using a screw press where the material to be pressed is subjected to a pressure that increases in the transport direction of the screw, is then compressed very strongly at least for a brief time at a minimum of one throttle point, and then undergoes at least a partial pressure relaxation, and is then further compressed.

Screw presses are used in various processes to remove fluids from many types of materials, such as e.g. oil seeds. Such a screw press is described e.g. in DE-C-29 15 538. The disclosed invention comprises essentially a screw and a perforated mantle surrounding the former, e.g. a screen. The mantle and the screw, or the screw shaft, form between them a screw channel that narrows in the known manner from the charging side in the transport direction of the screw. In the known state of the art this occurs in several steps by increasing the diameter of the screw shaft from step to step, but at the same time keeping the inside diameter of the mantle constant, so that the cross-section of the screw channel is decreased. In this way a pressure that becomes higher from step to step is built up in the material cake that is transported and pressed. Between the individual steps throttle points are provided in which a high pressure is built up locally and is then again at least partially reduced towards the next compression step. During operation of the previously described screw press, material is placed into the screw channel at the charging side via a filling pipe. The material is transported by the screw in the longitudinal direction of the screw channel, whereby it is compressed in several steps towards the discharge side so that the fluid is then pressed from the material, and is discharged through the openings in the mantle surface towards the outside. At the throttle points, which may be located either between two steps or within one step, the material cake is subjected to a very high compression over a very short distance. An increase in the cross-section then ensures that the pressure is at least partially reduced again. The initial cross-section of the step following in the transport direction is always smaller than the screw cross-section at the end of the preceding step. No spiral surfaces for transporting the cake are provided in the area of the throttle point.

The individual compression steps have scraping fingers that project through the mantle into the screw channel. The cake is scraped off the screw shaft by these scraping fingers and is also cut open in the longitudinal direction of the screw channel.

Also known is a screw press (DE-A-26 33 524) that has recesses in those spiral surfaces located near the filling pipe. The former are used to cut material with long fibers before it is compressed for pressing off the fluids.

In another known screw press (DE-A-27 51 703), throttle points are provided not only between two steps but also within one step. In this screw press the material cake is broken up and rearranged after the build-up of a high pressure in the throttle point and the subsequent partial decreases in the high pressure, before it is then further compressed in a subsequent step. However, the effectiveness of this screw press is still relatively low.

It is the task of this invention to propose a screw press for pressing off fluids and a process for pressing off fluids that is able to achieve a higher effectiveness, i.e. which is able to press off more fluid over the same press length.

The task that has been described is solved by a screw press having in the area of at least one of the existing throttle points at least one cam provided in the screw channel that may be moved transversely to the transport direction of the screw. Due to the movement of the cam transversely to the transport direction of the screw, the material cake that is being transported in the transport direction of the screw is broken up or cut into relatively small pieces. This cutting, in contrast to the known state of the art, is performed in the area of the throttle point, i.e. in a high pressure area or immediately following it. The pieces then shoot into the subsequent relaxation zone, i.e. the area with the larger cross-section. It was found that by cutting the cake in this area, the effectiveness of a screw press can be significantly improved. Naturally, it is not necessary for the cutting of the cake that the movement direction is exactly transverse, i.e. perpendicular, to the transport direction; but it is sufficient if the movement direction of the cam has a component that extends transversely to the transport direction.

To construct the invention, it is provided that in the area of the throttle point several such mobile cams are disposed so that the material can be cut into smaller pieces. These cams can be located on one level relative to the transport direction. But they may also be arranged offset to each other in transport direction.

In an advantageous manner, the cams can be disposed in the area of the highest pressure of the respective throttle point, i.e. in the area where the cross-section of the screw channel is the smallest. But the concept of the invention is applied also if the cam/s is/are disposed only at that place where the pressure becomes lower.

A further development of the invention provides that the cam/s is/are disposed in a co-rotating manner at the screw shaft. This automatically moves the cams with the screw or the screw shaft, so that no further mechanism for operating the cams is required. In order to facilitate the arrangement of the cams at the shaft, it may be expedient to connect a cam ring carrying several cams to the screw shaft in a co-rotating manner.

The task underlying the invention also is solved for a process for pressing off fluids in that the material is broken up or cut into fractions in the area of the throttle point. Hereby the breaking up or cutting may take place in the area with the highest pressure. The advantages resulting from this already have been explained.

The following explains an embodiment of the invention using the drawing. The drawing is the only figure, showing a longitudinal cross-section through a screw press.

The screw press comprises a screw (1) that is arranged inside a mantle (2) and may be rotated inside the latter about its longitudinal axis. The screw (1) is not constructed in one part but consists of a screw shaft (3) and a number of screw segments (4) that are arranged consecutively in axial direction of the screw shaft (3) and that have screw-like spiral surfaces (5). The screw segments (4) are connected in a co-rotating manner with the screw shaft (3).

The inside surface of the mantle (2) and the outside surface of the screw (1), i.e. the screw segments (4) form between them a screw channel (6) whose transport cross-section decreases in the transport direction of the screw (1) that is indicated in the drawing by an arrow. This is achieved in the manner in that the outside diameter of the screw decreases from the charging end towards the discharging end and the inside diameter of the mantle (2) decreases in transport direction.

In the screw channel (6), several spaced apart throttle points (7,8,9) are provided in transport direction. In the area of these throttle points the transport cross-section of the screw channel (6) decreases significantly over a short distance, so that a high pressure is built up here. Such a throttle point may be achieved in that, as is shown for the left throttle point (7) in the drawing, the inside diameter of the mantle (2) is reduced, or in that the outside diameter of the screw (1) is increased, as is shown for the other throttle points (8,9). The throttle points (8,9) have in the area of the lowest transport cross-section cams (10) that are arranged spaced apart from each other in the peripheral direction of a cam ring (11,12) that is connected to the screw shaft (3) in a co-rotating manner. The cam rings (11,12) are, like the screw segments (4), connected to the screw shaft (3) in a co-rotating manner, so that during a rotation of the screw shaft (3) the cams (10) are rotated along in the peripheral direction of the screw shaft (6). The drawing shows that after the area with the smallest transport cross-section, where the cams (10) are located, the transport cross-section of the screw channel (6) is increased, before the transport cross-section is then again decreased.

During operation of the screw press, material is filled into the screw channel (6) through a filling pipe (13) at the charging side .of the screw (1). During a rotary movement of the screw (1), this material is transported in longitudinal direction of the screw channel (6) through the screw-like spiral surfaces (5). The continuous reduction of the cross-section of the screw channel (6) causes the charged material to be further and further compressed towards the discharge end of the screw press, whereby fluid is pressed out of the material and passes through the mantle (2) that is constructed as a screen towards the outside where it is collected in a vessel that has not been shown in detail. In the area of the throttle points (8,9) the transport cross-section of the screw channel (6) significantly decreases over a short distance so that a high pressure is built up in the material cake here. In the area of the highest pressure, the cake that is moved in a straight line in longitudinal direction of the screw channel (6) is cut into small pieces by the cams (10) that rotate along with the throttle segment (8,9). Then the high pressure built up due to throttle points (8,9) is at least partially reduced again, so that the cut cake breaks down into small pieces. The cake is then compressed again so that further fluid can be pressed off.

It was found that a machine which 1) highly compresses the material flowing in the screw in the area of the throttle points; 2) then cuts the cake in the area of highest pressure; 3) then partially reduces the pressure; and 4) subsequently recompresses the cake results in a machine which is highly effective.

I claim:

1. A screw press for pressing off a fluid from a material flowing therein, comprising:
   a) a screw having a plurality of screw segments arranged consecutively in an axial direction of the press, each of said screw segments having an outer surface, each of said outer surfaces increasing in diameter for each consecutive screw segment in a transport direction;
   b) a fluid permeable mantel surrounding said screw and having an inner surface facing said screw outer surface defining a screw channel therebetween;
   c) a plurality of throttle points disposed between adjacent one of said screw segments where the cross-sectional area of said screw channel is reduced for building up zones of high pressure;
   d) at least one expansion area disposed downstream of a respective one of said plurality of throttle points, said expansion area defined where the cross-sectional area of said screw channel is increased for reducing the high pressure built up at the respective throttle point; and
   e) a cam transversely movable into one of said plurality of throttle points.

2. A screw press according to claim 1, wherein:
   a) said outer surface of each of the respective screw segments increases in diameter at the respective throttle points in the transport direction, so as to reduce the cross-sectional area of said screw channel.

3. A screw press according to claim 1, wherein:
   a) said inner surface of said mantel decreases in diameter at the respective throttle points in the transport direction, so as to reduce the cross-sectional area of said screw channel.

4. A screw press according to claim 1, wherein:
   a) said outer surface of each of the respective screw segments increases in diameter at the respective throttle points in the transport direction, so as to reduce the cross-sectional area of said screw channel; and
   b) said inner surface of said mantel decreases in diameter at the respective throttle points in the transport direction, so as to reduce the cross-sectional area of said screw channel.

5. A screw press according to claim 1, further including:
   a) said cam is disposed at the first of said throttle points.

6. A screw press according to claim 5, further comprising a plurality of said cams and wherein:
   a) said plurality of cams are arranged offset to each other in the transport direction.

7. A screw press according to claim 1, further comprising a plurality of said cams and wherein:
   a) said plurality of cams are each disposed in the zone of highest pressure of the respective plurality of throttle points.

8. A screw press according to claim 7, wherein:
   a) each of said cams is radially spaced from the respective screw segment.

9. A screw press according to claim 1, further comprising a plurality of said cams and wherein:
   a) a screw shaft extends through said screw segments; and b) said plurality of cams are rotatable with said screw shaft.

10. A screw press according to claim 9, wherein:

a) a cam ring is connected to said screw shaft and is rotatable therewith; and b) said plurality of cams form a portion of said cam ring.

11. A process for pressing off fluids, from a fluid containing material comprising the steps of:

a) providing a screw having a plurality of screw segments arranged consecutively in an axial direction of the press, each of the screw segments having an outer surface, each of said outer surfaces increasing in diameter for each consecutive screw segment in a transport direction;

b) providing a fluid permeable mantel surrounding the screw and having an inner surface facing the screw outer surface defining a screw channel therebetween;

c) flowing the fluid containing material into the screw channel;

d) increasing the pressure of the fluid containing material at a plurality of throttle points disposed between adjacent screw segments by reducing the cross-sectional area of the screw channel at each of the throttle point;

e) reducing the pressure of the fluid containing material following said increasing step at an expansion zone downstream from each of the throttle points;

f) providing a transversely moveable cam disposed at one of said throttle points; and g) breaking up the fluid containing material at said at least one of the throttle points with the transversely movable cam.

12. A screw press according to claim 11, including the step of:

a) breaking up the fluid containing material at least one throttle point during said increasing step.

13. A screw press according to claim 11, including the step of:

a) providing an outer surface for each of the respective screw segments which increases in diameter at the respective throttle points in the transport direction, so as to reduce the cross-sectional area of said screw channel.

14. A screw press according to claim 11, including the step of:

a) providing an inner surface of said mantel which decreases in diameter at the respective throttle points in the transport direction, so as to reduce the cross-sectional area of the screw channel.

15. A process according to claim 11, including the steps of:

a) providing an outer surface for each of the respective screw segments which increases in diameter at the respective throttle points in the transport direction, so as to reduce the cross-sectional area of said screw channel; and b) providing an inner surface of said mantel which decreases in diameter at the respective throttle points in the transport direction, so as to reduce the cross-sectional area of the screw channel.

* * * * *